US007614960B2

(12) United States Patent
Miller et al.

(10) Patent No.: US 7,614,960 B2
(45) Date of Patent: Nov. 10, 2009

(54) TRAINING PUTTER

(76) Inventors: Timothy L. Miller, 947 E. Johnstown Rd., Suite 263, Gahanna, OH (US) 43230; Jody Capuano, 947 E. Johnstown Rd., Suite 263, Gahanna, OH (US) 43230

( * ) Notice: Subject to any disclaimer, the term of this patent is extended or adjusted under 35 U.S.C. 154(b) by 0 days.

(21) Appl. No.: 12/027,019

(22) Filed: Feb. 6, 2008

(65) Prior Publication Data

US 2008/0287214 A1 Nov. 20, 2008

Related U.S. Application Data

(60) Provisional application No. 60/938,889, filed on May 18, 2007.

(51) Int. Cl.
*A63B 69/36* (2006.01)

(52) U.S. Cl. ..... 473/236; 473/251; 473/252

(58) Field of Classification Search ..... 473/219, 473/231, 236, 251, 252, 318, 340, 342
See application file for complete search history.

(56) References Cited

U.S. PATENT DOCUMENTS

| | | | | |
|---|---|---|---|---|
| 3,194,564 | A * | 7/1965 | Swan | 473/236 |
| 3,384,376 | A | 5/1968 | Greenlee | |
| 3,730,529 | A * | 5/1973 | Donofrio | 473/237 |
| 4,741,535 | A | 5/1988 | Leonhardt | |
| 5,135,229 | A | 8/1992 | Archer | |
| 5,213,332 | A | 5/1993 | Fahy et al. | |
| 5,351,961 | A | 10/1994 | Eulau | |
| 5,409,219 | A | 4/1995 | Saksun, Sr. | |
| 5,429,356 | A | 7/1995 | Dingle et al. | |
| 5,551,695 | A | 9/1996 | Wolk | |
| 5,595,543 | A * | 1/1997 | Wolk | 473/162 |
| 5,683,308 | A * | 11/1997 | Monette | 473/318 |
| 5,766,090 | A * | 6/1998 | Orlowski | 473/316 |
| 5,993,324 | A | 11/1999 | Gammil | |
| 5,997,409 | A | 12/1999 | Mattson | |
| 6,991,555 | B2 | 1/2006 | Reese | |
| 7,070,515 | B1 | 7/2006 | Liu | |
| 7,322,891 | B1 * | 1/2008 | Prewitt | 473/236 |
| 2004/0147332 | A1 * | 7/2004 | Engdahl | 473/236 |
| 2006/0122006 | A1 | 6/2006 | Hayd | |
| 2006/0223649 | A1 | 10/2006 | Rife | |

FOREIGN PATENT DOCUMENTS

| | | |
|---|---|---|
| JP | 2006-198385 | 8/2006 |
| JP | 2006-255358 | 9/2006 |

* cited by examiner

*Primary Examiner*—Sebastiano Passaniti
(74) *Attorney, Agent, or Firm*—McNees Wallace & Nurick LLC

(57) ABSTRACT

A club head for use with a golf putter is provided. This club head includes a body having a center longitudinal axis passing lengthwise therethrough; a first guide rod mounted within and passing through the body parallel to the center longitudinal axis and on one side thereof, wherein the first guide rod is selectively positional lengthwise within the body; and a second guide rod mounted within and passing through the body parallel to the center longitudinal axis and on the opposite side thereof, wherein the second guide rod is selectively positionable lengthwise within the body.

7 Claims, 3 Drawing Sheets

TRAINING PUTTER

CROSS-REFERENCE TO RELATED APPLICATIONS

This patent application claims the benefit of U.S. Provisional Patent Application Ser. No. 60/938,889 filed on May 18, 2007 and entitled "Training Device for Golf," the disclosure of which is incorporated by reference as if fully rewritten herein.

BACKGROUND OF THE INVENTION

The described invention relates in general to a training device for use with the game of golf, and more specifically to a golf club head for use with a putter, wherein the golf club head includes at least two independently adjustable guide rods that extend through the body of the putter parallel to the central longitudinal axis of the club head.

Training clubs and other training devices for use in teaching the fundamentals of the game of golf are as common as the game itself. While many of these devices are somewhat useful for their intended purpose, few golf training devices are designed for use by people with significant physical disabilities. Because golf is a highly visual game, people who suffer from blindness or other vision problems are often left without any means by which to learn, train for, and enjoy the game of golf. Therefore, there is an ongoing need for training devices for use in the game of golf that are designed for individuals suffering from blindness or other significant vision problems.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, a club head for use with a putter for the game of golf is provided. This golf club head includes: a body having a center longitudinal axis passing lengthwise therethrough; a first guide rod mounted within and passing through the body parallel to the center longitudinal axis and on one side thereof, wherein the first guide rod is selectively positionable lengthwise within the body; and a second guide rod mounted within and passing through the body parallel to the center longitudinal axis and on the opposite side thereof, wherein the second guide rod is selectively positionable lengthwise within the body.

In accordance with another aspect of the present invention, a putter head with integrated, sliding guide rods is provided. This putter head includes: a body having a center longitudinal axis passing lengthwise therethrough, wherein the body is adapted to receive a golf club shaft and a detachable club face; a first guide rod mounted within the body parallel to the center longitudinal axis and on one side thereof, wherein the first guide rod is selectively positionable lengthwise within the body; a second guide rod mounted within the body parallel to the center longitudinal axis and on the opposite side thereof, wherein the second guide rod is selectively positionable lengthwise within the body; and mechanical means for securing each guide rod within the body at a desired position.

In yet another aspect of this invention, a training device for use in the game of golf is provided. This training device includes a golf club head having a center longitudinal axis passing lengthwise therethrough; a golf club shaft attached to the golf club head, wherein the shaft is substantially center-mounted on the top of golf club head; and a club grip attached to the golf club shaft at the end thereof opposite the golf club head. The golf club head is shaped and weighted to be conducive to producing an even pendulum swinging motion in a single plane and is adapted to receive at least two guide rods mountable therein. The guide rods are mountable within the golf club head substantially parallel to the center longitudinal axis thereof, and are selectively positionable and selectively securable within the golf club head.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
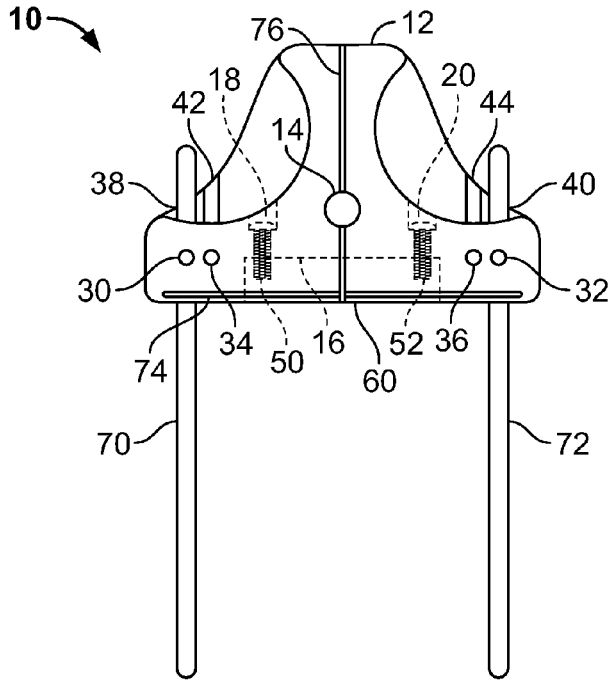
FIG. 1 is top view of an exemplary embodiment of the putter head of the present invention shown in an assembled state with the guide rods each positioned in a similar location within the body of the putter head.
Figure 2:
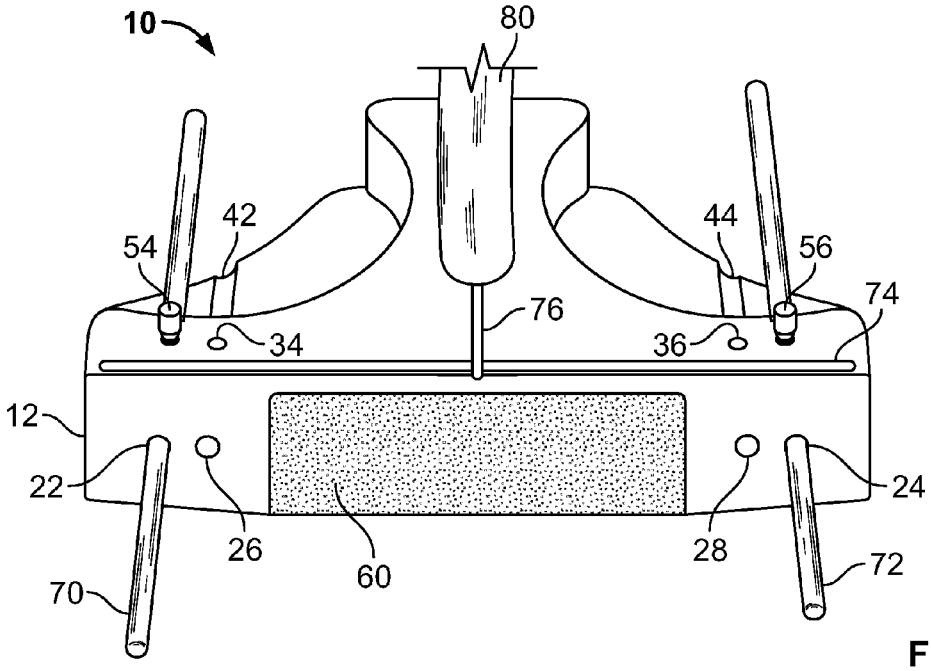
FIG. 2 is a front perspective view of the putter head of FIG. 1.

Exemplary embodiments of the present invention are now described with reference to the Figures. Reference numerals are used throughout the detailed description to refer to the various elements and structures. In other instances, well-known structures and devices are shown in block diagram form for purposes of simplifying the description. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to a training device for use in the game of golf. As previously indicated, a first general embodiment of this invention provides a club head for use with a putter; a second general embodiment of this invention provides a putter head that includes integrated guide rods; and a third general embodiment of this invention provides a training device for use with the game of golf. With reference now to the Figures, one or more specific embodiments of this invention shall be described in greater detail.

Figure 3:
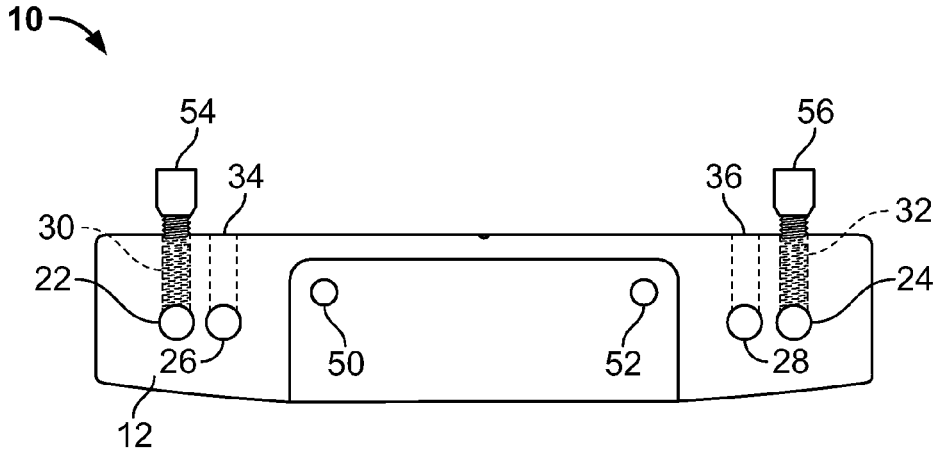
FIG. 3 is a front view of the putter head of FIG. 1.
Figure 4:
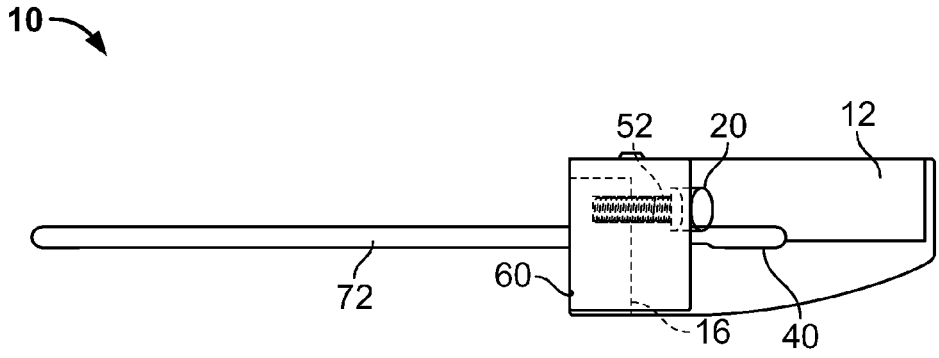
FIG. 4 is a side perspective view of the putter head of FIG. 1.

As shown in FIGS. 1-5, an exemplary embodiment of the present invention includes a putter head 10 that further includes a body 12 having at least two guide rods 70 and 72 mounted therein. In the exemplary embodiment shown in the Figures, body 12 is roughly triangular in shape; however, other shapes and geometric configurations are possible. Body 12 includes mounting aperture 14, which is adapted to receive the bottom portion of club shaft 80. Recess 16 is formed in the front surface of putter head 10 and is adapted to receive face plate 60, which may be removed and replaced with an alternate face plate, if desired. A bore 18 and a bore 20 are formed in body 12 and receive mounting bolts 50 and 52 respectively, both of which are used to attach face plate 60 to body 12. As best shown in FIG. 3, outer bores 22 and 24 are formed in body 12 to receive guide rods 70 and 72 respectively at one position within body 12, and inner bores 26 and 28 are formed in body 12 to receive guide rods 70 and 72 respectively at another position within body 12 which is closer to the central longitudinal axis thereof. Mounting apertures 30 and 32 correspond to the placement of outer bores 22 and 24 respectively and receive first tightening screw 54 and second tightening screw 56 respectively when guide rods 70 and 72 are mounted within outer bores 22 and 24. Mounting apertures 34 and 36 correspond to the placement of inner bores 26 and 28 respectively and receive first tightening screw 54 and second tightening screw 56 respectively when guide rods 70 and 72 are mounted within inner bores 26 and 28. Outer channels 38 and 40 correspond to the placement of outer bores 22 and 24 respectively and receive guide rods 70 and 72 respectively when the guide rods are mounted within outer bores 22 and 24. Inner channels 42 and 44 correspond to the placement of inner bores 26 and 28 respectively and receive guide rods 70 and 72 respectively when the guide rods are mounted within inner bores 26 and 28.

Figure 5:
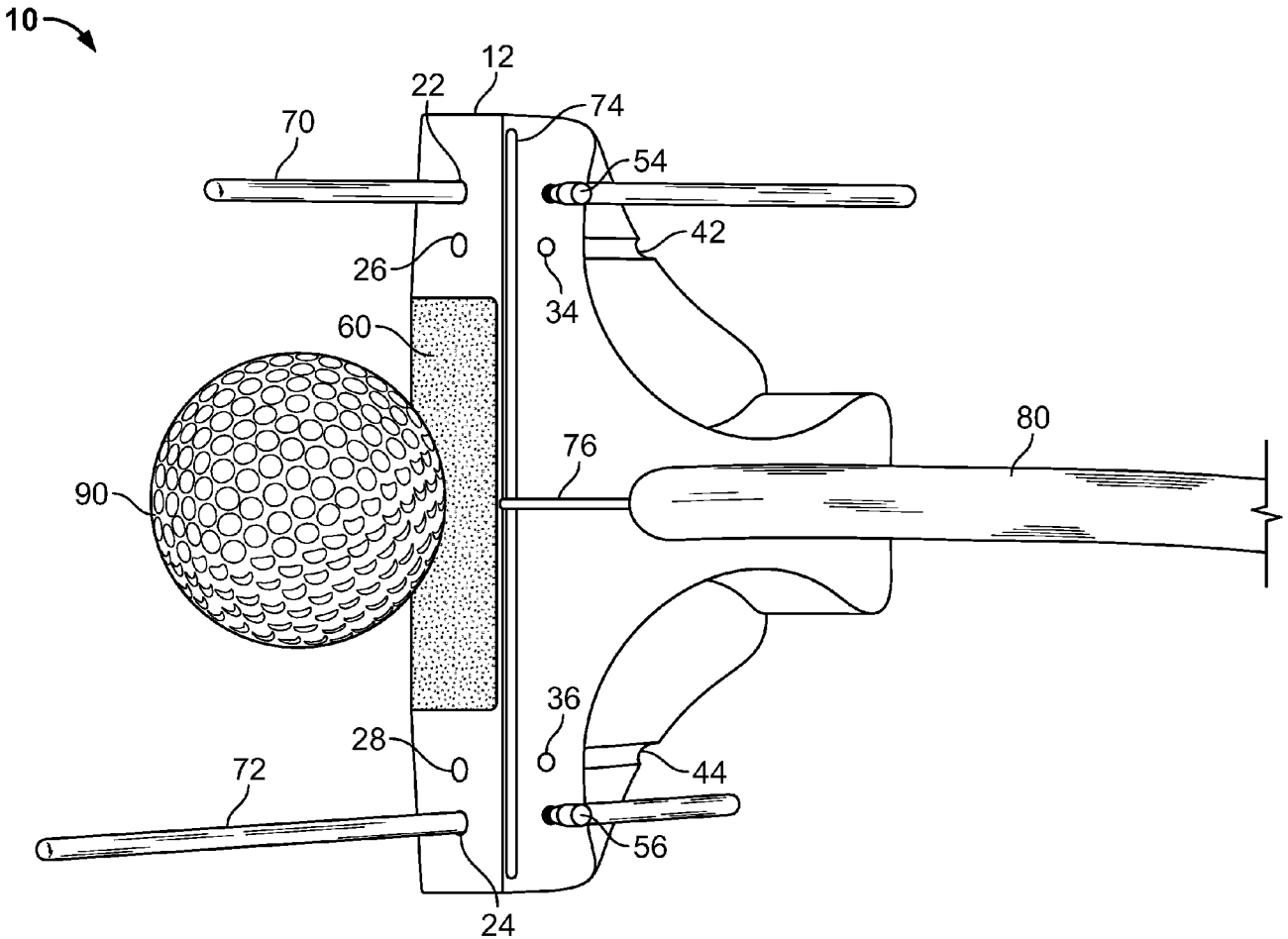
FIG. 5 is a top perspective view of the putter head of FIG. 1 showing the guide rods positioned in different locations relative to one another within the body of the putter head.

Guide rods 70 and 72 are typically manufactured from carbon fiber or another suitably strong and relatively lightweight material or combinations of materials. These rods are typically rounded at each terminal portion thereof. In the exemplary embodiment, guide rods 70 and 72 are about 6.0 inches (15.24 cm) in length, although other lengths (e.g., 4-10 inches) are possible based on user preference or other training factors. Guide rods 70 and 72 are inserted into body 12 through bores 22 and 24 or 26 and 28, and positioned according to user preference or trainer preference by simply sliding the rods within channels 38 and 40 or 42 and 44. Screws 54 and 56 (see FIG. 3) are then manually tightened into body 12 to secure guide rods 70 and 72 in the desired position and prevent unwanted movement when the putter is in use. To move guide rods 70 and 72, screws 54 and 56 are simply loosened and then re-tightened when the desired position for guide rods 70 and 72 is achieved. As shown in FIG. 5, guide rods 70 and 72 may be moved and positioned completely independent of one another. Guide rods 70 and 72 may also be removed from body 12 when the user or trainer desires to use putter head 10 without the guide rods.

As shown in the Figures, guide rods 70 and 72 are mounted within putter head 10 on either side thereof and may be moved forward or backward, independently of one another, based on the relative positions desired by the user of the training device and/or their coach or trainer. These guide rods provide a guiding or aiming means to the user of the club such than when the club swings forward or backward, the guide rods essentially track or follow the contours of the surface on which the user is putting. The guide rods basically prevent the user of the club from incorrectly tilting or turning the club face or the entire club head in the wrong direction. Substantially maintaining the golf club head in a single directional plane typically results in a golf shot that is much more likely to hit the intended target, i.e., the cup. In the exemplary embodiment shown in the Figures, the guide rods are generally cylindrical and are weighted to enhance the pendulum swinging effect. In other embodiments, the guide rods may include different configurations and different weights. For example, in another embodiment (not shown in the Figures), the forward ends of the guide rods are directed outward to form a Y-shaped channel. Numerous other variations are possible and are contemplated by the present invention.

In addition to the guide rods described herein, the golf club head of the present invention includes several features that are intended to create and reinforce a correct swinging/putting motion in the user of the device based on feel rather than vision. For example, as shown in the Figures, a significant portion of the weight of the club head is distributed lengthwise along the center longitudinal axis thereof such that the club head naturally swings in a relatively straight backward to forward manner. The overall length of the club head may be increased and more weight added thereto to further enhance this aspect of the club's performance. Also, in the exemplary embodiments discussed herein, the aperture that is adapted to receive a hozzle and shaft is "centrally" placed on the club head and is generally aligned with the extended back portion of the club head, as shown in the Figures. This configuration further encourages the development of a correct swinging motion. In other embodiments, the club shaft may include one or more vibration damping means for further enhancing accuracy.

A primary objective of the golf training device of the present invention is to create a certain "muscle memory" in the user that will allow the user to swing and/or putt in a far more consistent and accurate manner, even when the guide rods are not being used. Over the course of many swinging or putting repetitions, the unique features of the present invention will presumably create the desired muscle memory and the correct swinging motion will likely become instinctual to the golfer who has trained with this club. The user and/or coach may also utilize a golf ball 90 having a painted stripe thereon (see FIG. 5) for further encouraging and reinforcing a correct swing or putting motion. Because the club head of the present invention is intended for use with or without guide rods 70 and 72, guide lines 74 and 76 (see FIGS. 1, 2 and 5) may be included on the upward facing surface thereof to provide further means by which to correctly properly align the putter head with a golf ball. As will be appreciated by one of ordinary skill in the art, the golf club described herein and all components thereof can be manufactured, fabricated, or otherwise created using known techniques and methods. The exterior of the putter head 10 may be anodized to provide specific colors or color combinations based on user preference or aesthetic considerations.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A golf club head for use with a putter, comprising:

(a) a body having a center longitudinal axis passing lengthwise therethrough, wherein the body further includes:

(i) a plurality of bores formed therein and passing completely therethrough, wherein each of the bores is oriented parallel to the center longitudinal axis of the body and is adapted to receive a guide rod;

(ii) a plurality of mounting apertures formed therein, wherein each mounting aperture is oriented perpendicular to the central longitudinal axis of the body, and wherein each mounting aperture intersects one of the bores;

(b) a first adjustable guide rod mounted in one of the bores on one side of the center longitudinal axis, wherein the first guide rod passes completely through the bore in which it is mounted, and wherein the first guide rod is selectively positionable lengthwise within the body;

(c) a first manually-operated tightening screw, wherein the first tightening screw is operative to secure the first adjustable guide rod within the body when the first tightening screw is inserted into the mounting aperture that intersects the bore within which the first adjustable guide rod is mounted;

(d) a second adjustable guide rod mounted in one of the bores on the other side of the center longitudinal axis, wherein the second guide rod passes completely through the bore in which it is mounted, and wherein, the second guide rod is selectively positionable lengthwise within the body; and (e) a second manually-operated tightening screw, wherein the second tightening screw is operative to secure the second adjustable guide rod within the body when the second tightening screw is inserted into the mounting aperture that intersects the bore within which the second adjustable guide rod is mounted.

2. The golf club head of claim 1, wherein the shape and weight distribution of the club head produces an even pendulum swinging motion in a single plane when the club head is attached to a golf club shaft and the putter is in use.

3. The golf club head of claim 1, wherein the body is adapted to receive a golf club shaft and a detachable club face, and wherein the golf club shaft is substantially center-mounted on the top of golf club head.

4. The golf club head of claim 1, wherein each of the guide rods are between 4 and 10 inches in length and mountable within the body at multiple positions relative to the center longitudinal axis thereof.

5. The golf club head of claim 1, wherein each of the guide rods is manufactured from carbon fiber.

6. The golf club head of claim 1, wherein the terminal portions of each guide rod are rounded.

7. The golf club head of claim 1, wherein the golf club head further includes guide lines on the upward facing surface thereof for properly aligning the golf club head with a golf ball.

* * * * *